US008356978B2

(12) United States Patent
Beattie et al.

(10) Patent No.: US 8,356,978 B2
(45) Date of Patent: Jan. 22, 2013

(54) TURBINE AIRFOIL PLATFORM COOLING CORE

(75) Inventors: Jeffrey S. Beattie, South Glastonbury, CT (US); Matthew A. Devore, Manchester, CT (US); Matthew S. Gleiner, Vernon, CT (US); Douglas C. Jenne, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 559 days.

(21) Appl. No.: 12/623,666

(22) Filed: Nov. 23, 2009

(65) Prior Publication Data

US 2011/0123310 A1 May 26, 2011

(51) Int. Cl.
*F01D 5/00* (2006.01)

(52) U.S. Cl. ..... 416/193 A; 415/115; 416/97 R

(58) Field of Classification Search ..... 415/115, 415/116; 416/90 R, 92, 97 R, 193 A
See application file for complete search history.

(56) References Cited

U.S. PATENT DOCUMENTS 4,134,709 A * 1/1979 Eskesen ..... 416/1
4,712,979 A 12/1987 Finger
5,344,283 A 9/1994 Magowan et al.
5,382,135 A 1/1995 Green
5,413,458 A 5/1995 Calderbank
5,460,486 A * 10/1995 Evans et al. ..... 416/97 R
5,513,955 A 5/1996 Barcza
5,711,650 A 1/1998 Tibbott et al.
5,848,876 A 12/1998 Tomita
6,017,189 A 1/2000 Judet et al.
6,071,075 A 6/2000 Tomita et al.
6,120,249 A 9/2000 Hultgren et al.
6,190,130 B1 * 2/2001 Fukue et al. ..... 416/97 R
6,196,799 B1 * 3/2001 Fukue et al. ..... 416/97 R
6,210,111 B1 4/2001 Liang
6,254,333 B1 * 7/2001 Merry ..... 415/115
6,457,935 B1 10/2002 Antunes et al.
6,475,935 B1 11/2002 Ishizaki et al.
6,638,012 B2 10/2003 Bekrenev
6,641,360 B2 11/2003 Beeck et al.
6,945,749 B2 9/2005 DeCardenas
6,945,750 B2 9/2005 Benedetti et al.
7,186,089 B2 3/2007 Liang
7,255,536 B2 8/2007 Cunha et al.
7,309,212 B2 12/2007 Itzel et al.

* cited by examiner

*Primary Examiner* — Ninh H Nguyen
*Assistant Examiner* — Liam McDowell
(74) *Attorney, Agent, or Firm* — Carlson, Gaskey & Olds, PC

(57) ABSTRACT

A gas turbine engine component has a platform and an airfoil extending from the platform. The platform has a pressure side and a suction side. A cooling passage is formed within the platform, and extends along a pressure side of the platform. Air leaves the passage through an air outlet on a suction side of the platform.

18 Claims, 4 Drawing Sheets

TURBINE AIRFOIL PLATFORM COOLING CORE

This invention was made with government support under Contract No. F33615-03-D-2354-0009 awarded by the United States Air Force. The Government may therefore have certain rights in this invention.

BACKGROUND OF THE INVENTION

This application relates to a cooling passage for a platform in a gas turbine component.

Gas turbine engines include a compressor which compresses air and delivers it downstream into a combustion section. The air is mixed with fuel in the combustion section and ignited. Products of this combustion pass downstream over turbine rotors, which are driven to rotate. In addition, static vanes are positioned adjacent to the turbine rotors to control the flow of the products of combustion.

The turbine rotors carry blades. The blades and the static vanes have airfoils extending from platforms. The blades and vanes are subject to extreme heat, and thus cooling schemes are utilized for each.

It is known to provide a cooling passage in the platform of the vanes and blades to cool the platform on the pressure side. Such passages have an outlet on the pressure side of the platform.

SUMMARY OF THE INVENTION

A gas turbine engine component has a platform and an airfoil extending from the platform. The platform has a pressure side and a suction side. A cooling passage is located within the platform, and extends along a pressure side of the platform. Air leaves the passage through an air outlet on a suction side of the platform.

These and other features of the present invention can be best understood from the following specification and drawings, the following of which is a brief description.

DETAILED DESCRIPTION OF THE PREFERRED EMBODIMENT

Figure 1:
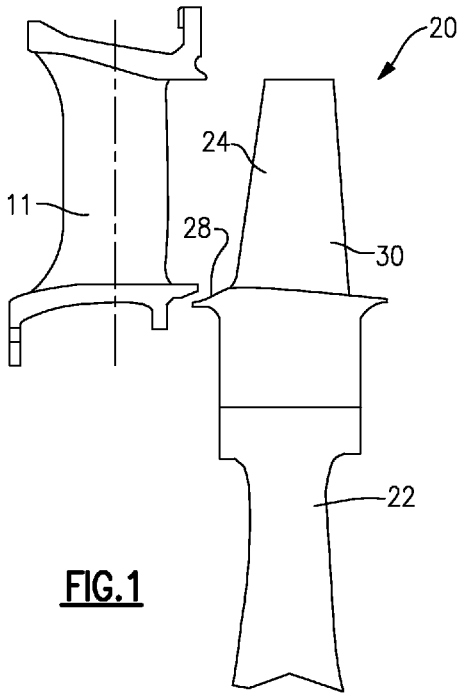
FIG. 1 shows a turbine rotor.

FIG. 1 shows a turbine section 20 including a rotor 22 carrying a blade 24. Blade 24 includes a platform 28 and an airfoil 30. As also shown, a vane 11 is positioned adjacent to the blade 24.

Figure 2:
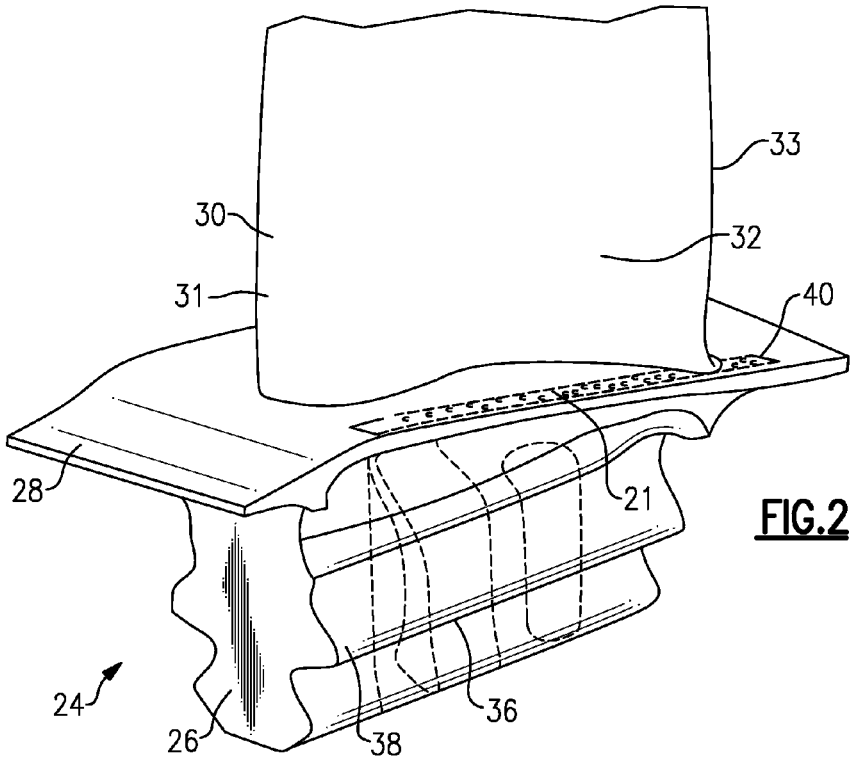
FIG. 2 is a partial view of a turbine blade.

As shown in FIG. 2, airfoil 30 has a leading edge 31 and a trailing edge 33. A pressure side 32 of the airfoil is shown in this Figure. A cooling passage 34 is positioned on the pressure side of the airfoil, and in the platform 28. The cooling passage 34 extends to an outlet 40, which, as will be explained below, sits on a suction side of the platform 28. The blade 24 includes a root section 26 which is utilized to secure the blade within the rotor. In addition, a plurality of cooling passages 36 and 38 extend through the root 26 from a cooling air supply and upwardly into the airfoil 30, as known.

Figure 3:
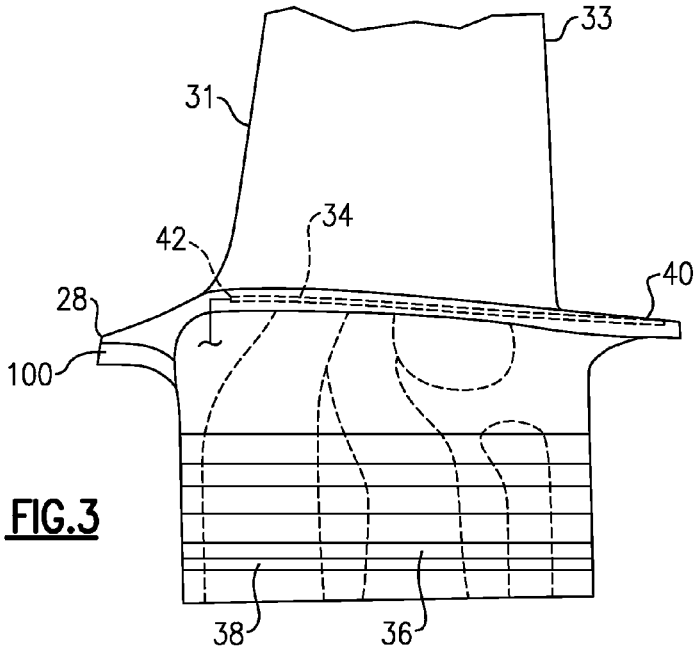
FIG. 3 is a cross-sectional view through the platform of the FIG. 2 blade.

As shown in FIG. 3, the cooling passage 34 has an inlet 42 for supplying air. As shown, the inlet 42 comes into the platform 28 at a lower surface, and rearward of a leading edge 100 of the platform 28. Cooling air passes into an inlet 42, through the cooling passage 34, and outwardly of the outlet 40 cooling the platform 28. The inlet 42 to the cooling passage 34 can be from any number of locations depending on the particular design, and the environment in which the component is to be utilized. A worker of ordinary skill in the art would be able to identify any number of potential sources of cooling air. As shown, a source of air communicates to the inlet.

Figure 4:
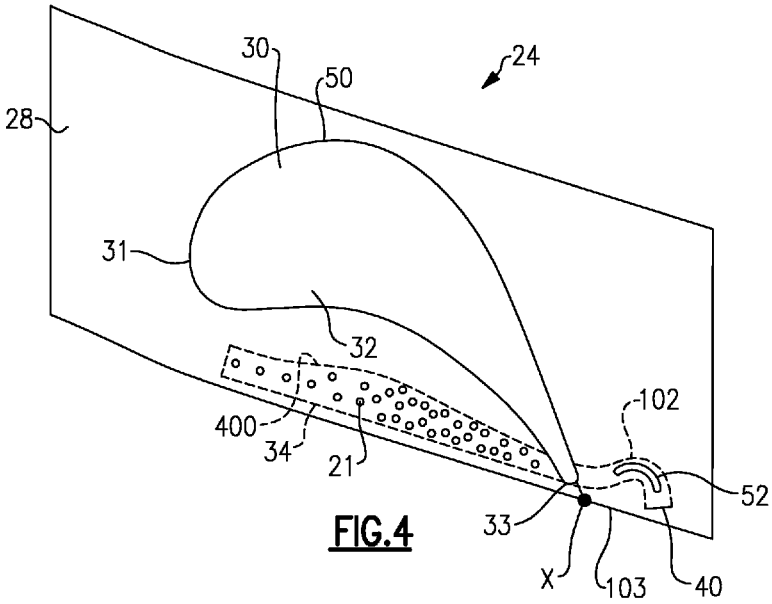
FIG. 4 is a top view of a first embodiment.

As can be appreciated from FIG. 4, the airfoil 30 has a suction side 50. The outlet 40 of the cooling passage 34 is on the suction side of the platform. Stated another way, should the airfoil be extended from the trailing edge 33 to the edge 103 of the platform 28, it will be at a position X. This could be defined as a dividing line between the pressure and suction sides of the platform. The outlet 40 is on the suction side.

In the FIG. 4 embodiment, the cooling passage 34 passes through the platform, and beneath the trailing edge 33 before getting to the outlet 40. As can be appreciated also from this Figure, the end 102 of the cooling passage curves away from the edge 103, before curving back toward the edge 103 and reaching outlet 40. The curve shown at the end 102, and leading toward the outlet 40, assists in directing the exiting air flow to line up with the main gas air flow through the gas turbine engine. However, a straight passage to the outlet may also be utilized. As shown, the cooling passage has a bulged intermediate portion 400. The bulged portion 400 increases the cooling surface area at a particular location along the path, and further allows better heat transfer characteristics.

Various cooling structures may be included in the cooling passage 34. Pin fins, trip strips, guide vanes, pedestals, etc., may be placed within the passage to manage stress, gas flow, and heat transfer. As shown, a number of pins 21 may be formed within the cooling passage 34 to increase the heat transfer effect. As mentioned, any number of other heat transfer shapes can be utilized, including a rib 52 adjacent the outlet. Further, if there are localized hot spots, outlet holes can be formed either to the outer face of the platform, or to the outer edge 103, as deemed appropriate by the designer. Additionally, holes can be drilled from the underside of the platform to supply additional air to the passage.

As is clear, the curving ends 102 and 150 are located on the suction sides of their respective embodiments.

Figure 5:
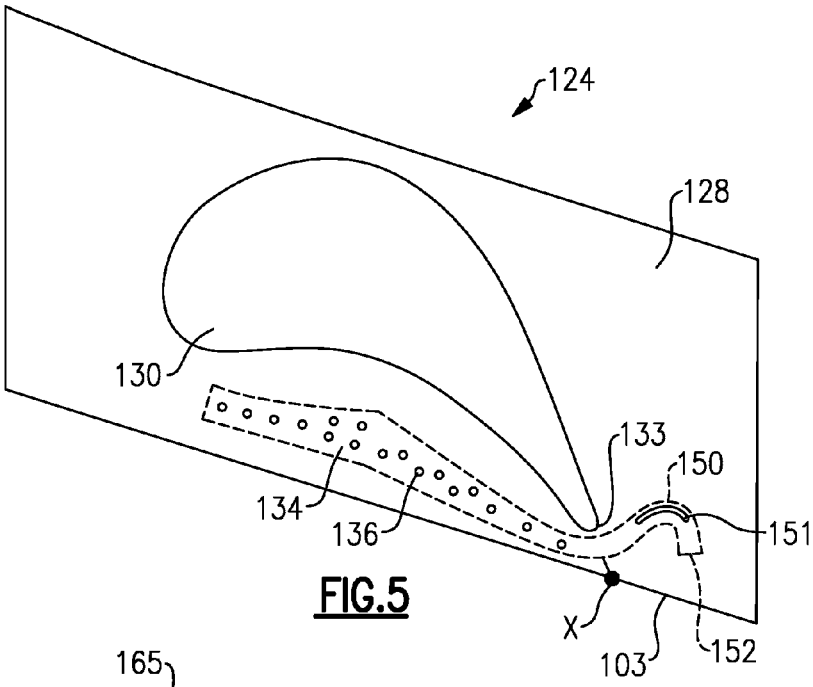
FIG. 5 shows a second embodiment.

As shown in FIG. 5, a second embodiment 124 has platform 128, and platform cooling passage 134. Again, an extension from the trailing edge 133 of the airfoil 130 reaches point X. The cooling passage 134 passes around the airfoil trailing edge 133, and the outlet 152 of the cooling passage 134 is on the suction side of point X, and the suction side of the platform 128. Stated another way, the cooling passage does not pass underneath the airfoil, but instead is positioned between the trailing edge 133 and the side wall of the platform when passing from the pressure side to the suction side. Again, the end 150 curves away from the edge 103, and a rib 151 is included.

All of the above discussed cooling features, such as features 136 and 151, and holes can be utilized.

Figure 6A:
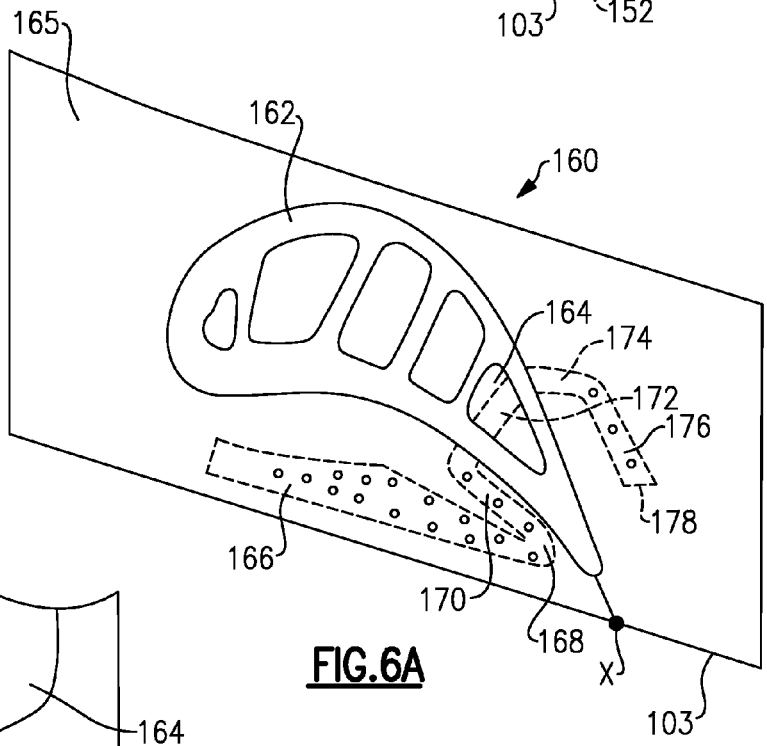
FIG. 6A shows yet another embodiment.

FIG. 6A shows yet another embodiment 160 having a platform 165, and an airfoil 162. Here, the cooling passage 166 has a serpentine path, including a curve 168 on the pressure side, which leads to a leading edge extending portion 170, a crossing portion 172, a portion 174, which is now on the suction side, and which leads to a final portion 176 leading to the outlet 178. Again, the outlet 178 is on the suction side, and on an opposed side of the point X from the inlet to the cooling passage 166.

In the FIG. 6A embodiment, a central passage 164 in the airfoil 162 can be seen to have the cooling passage portion 172 passing underneath.

Figure 6B:
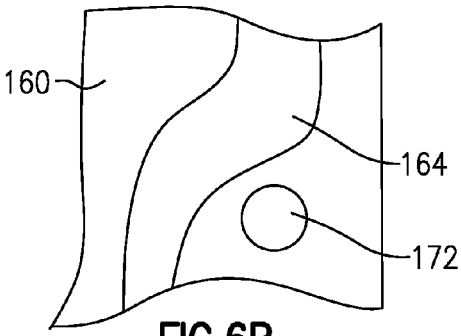
FIG. 6B shows a portion of the FIG. 6A embodiment.

As shown in FIG. 6B, the passage 172 preferably does not communicate with the passage 164 when passing underneath the passage 164. In addition, while the serpentine passage 166 is disclosed, a more direct route underneath the airfoil can also be utilized.

The inlet to the cooling passages in FIGS. 4-6 may be positioned anywhere, as mentioned above.

Figure 7:
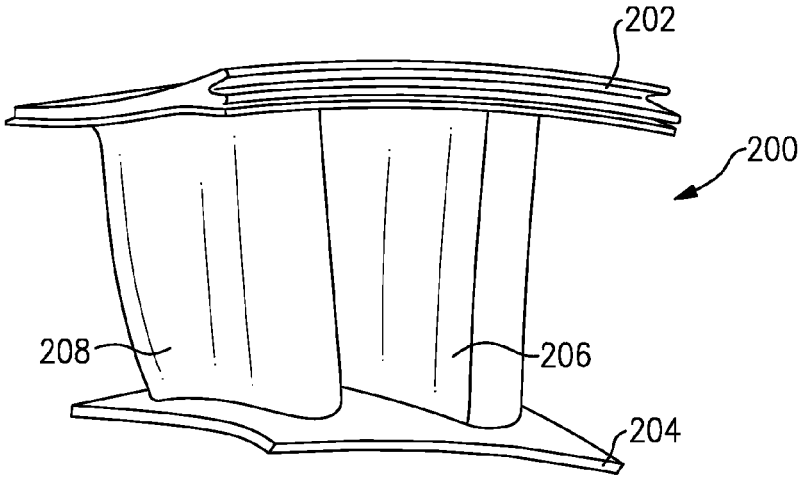
FIG. 7 shows a static vane.

An embodiment 200 is shown in FIG. 7, wherein the cooling passage is incorporated into a static vane arrangement. As shown, vane airfoils 208 and 206 extend between platforms 202 and 204. The platform 204 will be a radially inner end wall when the vane embodiment 200 is mounted within an engine, while the platform 202 will be radially outwardly. While a dual vane arrangement is shown, a single vane may also incorporate the cooling passage, as may any number of other static vane arrangements.

Figure 8:
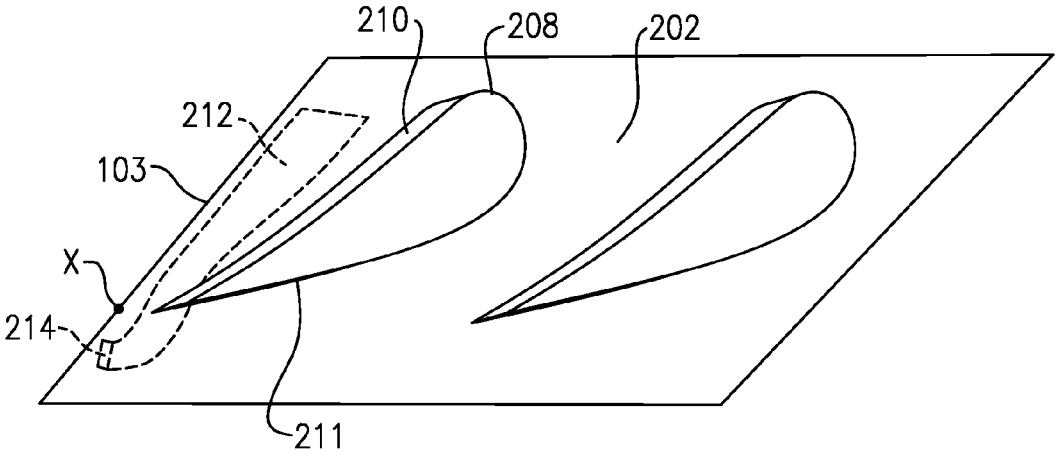
FIG. 8 is a top view of the FIG. 7 vane.

As shown in FIG. 8, again, a cooling passage 212 is formed on a pressure side 210 of the airfoil 208. The outlet 214 is again on the suction side 211, and on an opposed side of the point X from the inlet to the cooling passage 212.

As can be appreciated from the several embodiments, the outlet is located on a radially outer face of the platforms, and not through the edge 103. The above is true of all of the embodiments. In the vane embodiments, the "outer face" is facing radially inwardly, but from a functional standpoint, the face of the platform from which the airfoil extends is the "radially outer face" for purposes of this application.

The cooling passages 34 may be formed from any suitable core material known in the art. For example, the cooling passage 34 may be formed from a refractory metal or metal alloy such as molybdenum or a molybdenum alloy. Alternatively, the cooling passage 34 may be formed from a ceramic or silica material.

The cooling passage 34 can be formed by a lost core molding technique, as is known in the art. Alternatively, the passage can be created by welding a plate onto the part after the passage has been created by a molding technique. Any number of other ways of forming such internal structure can also be utilized.

The platform cooling passage provides shielding to the underplatform from hot gases. Shielding reduces heat pick-up in the rim, potentially improving rotor/seal/damper, etc. life. Shielding also reduces bulk panel temperatures, which increases creep life on the end wall.

Although several embodiment of this invention have been disclosed, a worker of ordinary skill in this art would recognize that certain modifications would come within the scope of this invention. For that reason, the following claims should be studied to determine the true scope and content of this invention.

What is claimed is:

1. A gas turbine engine component comprising:

a platform, and an airfoil extending from said platform, said platform having a pressure side and a suction side;

a cooling passage located within said platform, and extending along the pressure side of said platform, and an outlet for air leaving said cooling passage, said outlet being on the suction side of said platform; and said outlet is at a radially outer face of said platform, and not through an edge of said platform.

2. The component as set forth in claim 1, wherein an extension of a trailing edge of said airfoil can be extended to a point on a side wall of said platform, and said cooling passage is on one side of said point, and said outlet being on an opposed side.

3. The component as set forth in claim 1, wherein said cooling passage passes beneath a portion of said airfoil between an inlet and said outlet.

4. The component as set forth in claim 3, wherein said cooling passage passes beneath a trailing edge of said airfoil, and to said suction side.

5. The component as set forth in claim 3, wherein said airfoil has internal cooling passages, and said cooling passage passes beneath one of said internal cooling passages in said airfoil before reaching said outlet on said suction side.

6. The component as set forth in claim 1, wherein said cooling passage does not pass underneath said airfoil, but instead is positioned between a trailing edge of said airfoil, and a side wall of said platform when passing from said pressure side to said suction side.

7. The component as set forth in claim 1, wherein an end of said cooling passage, and on said suction side, leading to said outlet curves toward a first side wall of said platform, and then turns back to an opposed side wall of said platform.

8. The component as set forth in claim 1, wherein said cooling passage has a bulged intermediate portion to increase heat transfer by increasing contact area between said cooling passage and a portion of said platform.

9. The component as set forth in claim 1, wherein cooling structures elements are positioned within said cooling passage.

10. The component as set forth in claim 1, wherein said component is a turbine blade.

11. The component as set forth in claim 1, wherein said component is a static vane.

12. The component as set forth in claim 11, wherein said static vane has a platform at both a radially outer edge and a radially inner edge.

13. The component as set forth in claim 12, wherein said cooling passage is located in said radially outer edge platform.

14. The component as set forth in claim 1, wherein said radially outer face faces radially inwardly.

15. The component as set forth in claim 1, wherein said radially outer face faces radially outwardly.

16. A gas turbine engine component comprising:

a platform, and an airfoil extending from said platform, said platform having a pressure side and a suction side;

a cooling passage formed within said platform, and extending along a pressure side of said platform, and an outlet for air leaving said passage, said outlet being on a suction side of said platform;

an extension of a trailing edge of said airfoil can be extended to a point on said side wall of said platform, and said inlet to said cooling passage will be on one side of said point, and said outlet being on an opposed side; and said outlet is at a radially outer face of said platform.

17. The gas turbine engine as set forth in claim 16, wherein said radially outer face faces radially inwardly.

18. The gas turbine engine as set forth in claim 16, wherein said radially outer face faces radially outwardly.

* * * * *